United States Patent [19]

Kushner et al.

[11] Patent Number: 5,059,095

[45] Date of Patent: Oct. 22, 1991

[54] TURBINE ROTOR BLADE TIP COATED WITH ALUMINA-ZIRCONIA CERAMIC

[75] Inventors: Burton A. Kushner, Old Behtpage; Anthony J. Rotolico, Hauppauge; John E. Nerz, Seldon; Lawerence A. Saia, Levittown, all of N.Y.

[73] Assignee: The Perkin-Elmer Corporation, Norwalk, Conn.

[21] Appl. No.: 429,256

[22] Filed: Oct. 30, 1989

[51] Int. Cl.[5] ..... B64C 11/00; B64C 27/00

[52] U.S. Cl. ..... 416/241 B; 415/200; 29/889.21; 29/889.23

[58] Field of Search ..... 415/200; 416/241 R, 416/241 B; 29/889, 889.21, 889.22, 889.23; 427/423

[56] References Cited

U.S. PATENT DOCUMENTS

| | | | |
|---|---|---|---|
| 3,092,306 | 6/1963 | Eder | 415/200 |
| 3,145,287 | 8/1964 | Siebein et al. | 219/75 |
| 3,436,248 | 3/1965 | Dittrich et al. | 427/423 |
| 3,617,358 | 11/1971 | Dittrich | 427/423 |
| 3,887,412 | 6/1975 | Styhr et al. | 416/241 B |
| 3,951,612 | 4/1976 | Gates et al. | 416/241 R |
| 3,966,353 | 6/1976 | Booher, Jr. et al. | 415/200 |
| 3,974,245 | 8/1976 | Cheney et al. | 75/336 |
| 4,027,367 | 6/1977 | Rondeau | 427/422 |
| 4,247,249 | 1/1981 | Siemers | 415/200 |
| 4,280,975 | 7/1981 | Ammann | 416/218 |
| 4,416,421 | 11/1983 | Browning | 239/79 |
| 4,492,522 | 1/1985 | Rossmann et al. | 415/200 |
| 4,540,336 | 9/1985 | Cawley | 415/173.4 |
| 4,576,874 | 3/1986 | Spengler et al. | 428/623 |
| 4,588,655 | 5/1986 | Kushner | 428/633 |
| 4,595,663 | 6/1986 | Krohn et al. | 416/241 B |
| 4,663,243 | 5/1987 | Cziick et al. | 427/423 |
| 4,802,828 | 2/1989 | Rutz et al. | 416/241 B |
| 4,865,252 | 9/1989 | Rotolico et al. | 239/8 |
| 4,884,820 | 12/1989 | Jackson et al. | 416/241 B |

OTHER PUBLICATIONS

"Some Recent Developments of Flame-and-Plasma-Spraying Powders" by H. R. Eschauer and B. Krismer, International Thermal Spray Conference, Miami FL (Sep. 1976).

*Primary Examiner*—Edward K. Look
*Assistant Examiner*—Hoang Nguyen
*Attorney, Agent, or Firm*—H. S. Ingham; E. T. Grimes

[57] ABSTRACT

A rotor blade is for a gas turbine engine having a plurality of rotor blades and a substantially coaxial shroud encompassing the tips of the blades. A ceramic layer is bonded to the blade tip, the ceramic layer consisting of a combination of aluminum oxide and zirconium oxide or at least partially stabilized zirconium oxide. The ceramic layer is formed as a plasma sprayed coating or a high velocity oxy-fuel sprayed coating.

29 Claims, 1 Drawing Sheet

TURBINE ROTOR BLADE TIP COATED WITH ALUMINA-ZIRCONIA CERAMIC

This invention relates to gas turbine engines and particularly to a rotor blade for a gas turbine engine, wherein the rotor blade has a tip with a ceramic layer thereon.

BACKGROUND OF THE INVENTION

A gas turbine engine includes a number of rotor sections axially aligned, each having a hub (or portion of a common hub) with a plurality of equally spaced rotor blades mounted on the hub. A shroud encompasses the blade tips with as little clearance as possible in order to minimize bypass flow of air or other gases past the tips of the blades. The shroud is substantially but not necessarily exactly coaxial, because it is very difficult to fabricate and maintain a shroud that is exactly round and located right at the blade tips, particularly with some flexing of the shroud.

One solution is to utilize a clearance sealing layer on the shroud that is abraded by the blade tips, thus producing a self-adjusting, relatively tight seal, for example as disclosed in U.S. Pat. No. 4,540,336 (Cawley). In the higher temperature sections of an engine a ceramic type abradable material is necessary such as described in U.S. Pat. No. 4,280,975 (Ammann). However, shroud materials, particularly ceramics, have a tendency to wear the tips of the blades which generally are formed of a metal, changing the dimensions and configurations of the blade tips designed for the engine. In the case of titanium blades, metallic friction against the shroud is a concern for fire.

Coatings have been provided on rotor blade tips to alleviate these problems. One example is thermal sprayed chromium oxide on a titanium blade. Another is low pressure plasma sprayed nickel cobalt-chromium-aluminum-yttrium alloy with abrasive SiC grit imbedded therein, on a nickel superalloy blade tip. Yet another is boron nitride in a metal matrix, brazed to the tip. However a need still exists for an improved ceramic material for rotor blade tips, having lower friction and combined with higher abrasive qualities, and lower cost.

One convenient method of applying coatings is thermal spraying. Thermal spraying, also known as flame spraying, involves the heat softening of a heat fusible material such as metal or ceramic, and propelling the softened material in particulate form against a surface which is to be coated. The heated particles strike the surface where they are quenched and bonded thereto. Conventional thermal spray guns are used for the purpose of both heating and propelling the particles. In some types of thermal spray guns, the heat fusible material is supplied to the gun in powder form. Such powders are typically comprised of small particles, e.g., between 100 mesh U.S. Standard screen size (149 microns) and about 5 microns.

High velocity thermal spraying such as with a plasma gun such as in U.S. Pat. No. 3,145,287 (Siebein et al) produces relatively dense coatings. Another type of thermal spraying involves a high velocity oxy-fuel (HVOF) gun, such as taught in U.S. Pat. No. 4,865,252 (Rotolico) and in U.S. Pat. No. 4,416,421 (Browning). In HVOF, oxygen and fuel are supplied at high pressure into a combustion chamber such that the flame issues from a nozzle at supersonic velocity. In either plasma or HVOF powder fed into the flame is heated and propelled at high velocity to produce a dense coating.

A number of ceramic materials are utilized in the thermal spray process, for example zirconia plasma sprayed onto blades for thermal barrier or corrosion protection, as taught in U.S. Pat. No. 4,576,874. Metallic bond coats are often used as further taught in this patent. Aluminum oxide is a conventional thermal spray material. U.S. Pat. No. 4,588,655 (Kushner), and a paper "Some Recent Developments of Flame- and Plasma-Spraying Powders" by H. R. Eschnauer and B. Krismer, International Thermal Spray Conference, Miami Fla. (September 1976), describe the thermal spraying of alloyed zirconium oxide and aluminum oxide; no particular applications are disclosed in these references.

An object of the present invention is to provide an improved rotor blade for a gas turbine engine having a plurality of rotor blades and a substantially coaxial shroud encompassing the tips of the blades. Further objects are to provide such a blade having a tip layer of ceramic, to provide such a blade having improved friction characteristics against shroud material, to provide such a blade having improved ability to abrade shroud material, to provide such a blade having improved resistance to tip wear, and to provide an improved method for producing such a rotor blade.

SUMMARY OF THE INVENTION

The foregoing and other objects are achieved by a rotor blade for a gas turbine engine having a plurality of rotor blades and a substantially coaxial shroud encompassing the tips of the blades, comprising a blade member with an inner end adapted for mounting on a rotation hub and with a blade tip located opposite the inner end, and a ceramic layer bonded to the blade tip. The ceramic layer consists essentially of aluminum oxide and a zirconia-based oxide selected from the group consisting of zirconium oxide and at least partially stabilized zirconium oxide. Preferably the ceramic layer is formed as a thermal sprayed coating, most preferably either a plasma sprayed coating or a highly velocity oxy-fuel sprayed coating. The ceramic layer may be bonded to the blade tip with a thermal sprayed intermediate layer of a metal. In one embodiment the ceramic layer comprises substantially distinct phases of the aluminum oxide and the zirconia-based oxide, formed by thermal spraying a blend of aluminum oxide and zirconia-based oxide powders. In another embodiment the ceramic layer comprises substantially alloyed aluminum oxide and zirconium oxide, formed by thermal spraying a powder of aluminum oxide and zirconia-based oxide the powder consisting of composite powder or fused powder.

DETAILED DESCRIPTION OF THE INVENTION

Figure 1:
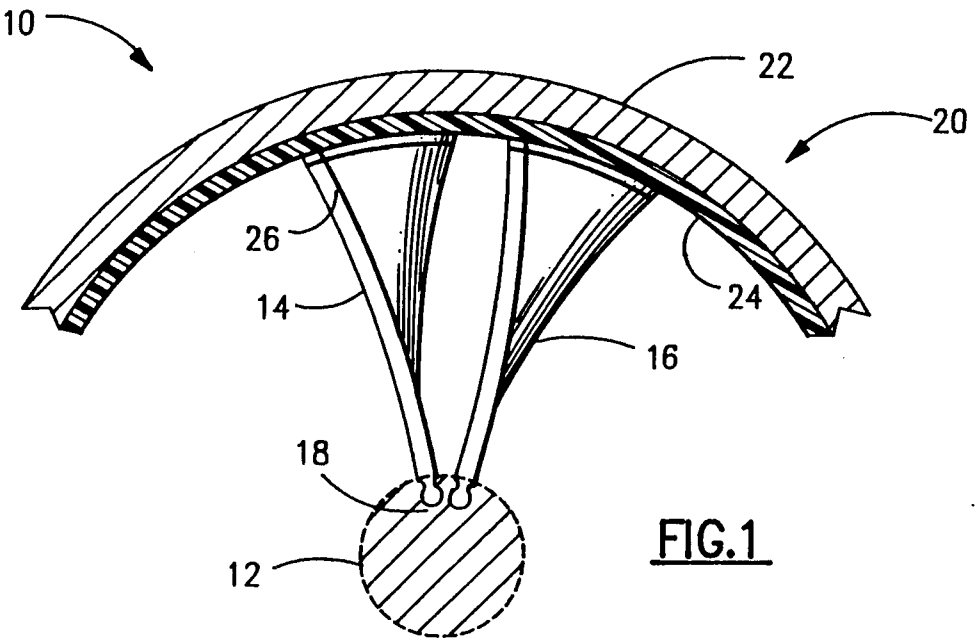
FIG. 1 is a partial cross section of a rotor section of a turbine engine including a rotor blade.

FIG. 1 illustrates a rotor section 10 of a gas turbine engine including a hub 12 that rotates and is connected axially to other rotor sections in the engine. Two blades 14, 16 are illustrated in an actual turbine a plurality of blades are equally spaced arcuately about the hub. Each blade has an inner end, i.e. root 18, that is adapted for mounting on the hub. A substantially coaxial shroud 20 is formed of at least a base member 22 and, desirably, an abradable coating 24 for example of plasma sprayed zirconium oxide. The tips 26 (i.e. outer ends) of the blades are essentially as close as possible to the coating of the shroud so as to rub against the coating, at least in some areas.

Figure 3:
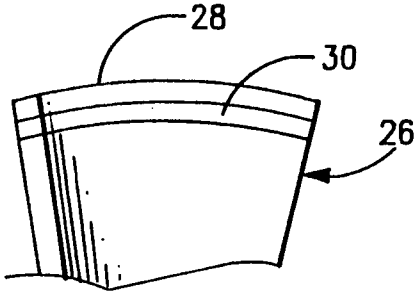
FIG. 3 is a portion of a rotor blade of FIG. 1 incorporating a further embodiment of the invention.
Figure 2:
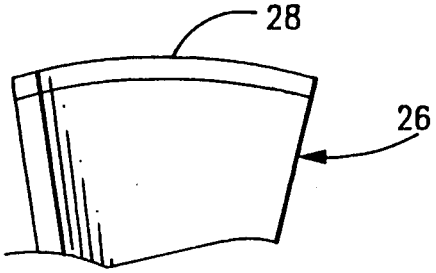
FIG. 2 is a portion of a rotor blade of FIG. 1 incorporating an embodiment of the invention.

FIG. 2 shows in more detail a blade portion of the blade including the tip with a ceramic layer 28 bonded thereto. FIG. 3 shows an embodiment wherein the ceramic layer 28 is bonded with an intermediate layer 30 of a metal.

According to the present invention the ceramic layer consists essentially of $Al_2O_3$ aluminum oxide (alumina) and a zirconia based oxide comprising $ZrO_2$ zirconium oxide (zirconia), and is preferably produced as a thermal sprayed coating. Most preferably the coating is generated by high velocity spraying such as by plasma spraying or high velocity oxy-fuel (HVOF) spraying. The high velocity produces a particularly dense coating of the aluminum-zirconia, found to provide an improved tip for a rotor blade.

Powder for the thermal spraying must have a size suitable for melting in the plasma or combustion flame, generally between 5 and 150 microns. Advantageously the size is substantially from 10 to 90 microns.

Broadly the alumina may be present in a proportion anywhere in the range of about 2% to 85% by weight based on the total of the aluminum oxide and the zirconia-based oxide. If high abrasiveness or abradability is desired, a preferably range is 40% to 85%. If especially low rubbing friction against the shroud is desired, a preferable range is 2% to 40%. Most preferably the proportion is 40% to 60%.

The zirconia-based oxide is neat zirconia or zirconia which is at least partially stabilized in a conventional or desired manner before being combined with the alumina. Partial or full stabilizing is generally necessary to prevent or at least minimize a phase transformation that occurs in pure zirconia at elevated temperature. Typical stabilizing oxides and preferred percentages (by weight, based on the total of stabilizer and zirconia) are yttrium oxide (5% to 25%), calcium oxide (2% to 8%), cerium oxide (25%) and magnesium oxide (24%). These may be used in combination, for example ceria and yttria, or a further additive such as titanium oxide may be utilized. Yttrium oxide is quite suitable, most preferably present in 6–8% (partially stabilized) or 20%. The relative percentages of aluminum oxide, as presented herein and in the claims, are with respect to the total with neat or stabilized zirconia, i.e., include stabilizer if any.

The alumina and zirconia may be present in the coating layer either as substantially distinct phases of each, or as an alloy of the two oxides. ("Alloyed" oxide as used herein and in the claims means solutioning or the like of oxides, and does not mean a metallic alloy which is separately described herein.) The distinct phase option may be thermal sprayed using a simple blend of alumina and zirconia powders. In this case it is particularly important that the zirconia be stabilized.

Alloyed alumina-zirconia is in the form of solutioning of these two constituents, there being a eutectic at about equal mol proportions, i.e. 60% by weight alumina. The alumina will stabilize the zirconia, so another stabilizing oxide may not be necessary in the case of an alloyed oxide layer.

However, an added stabilizer is desirable in case there is insufficient solutioning of the alumina or to optimize stabilization at high temperature.

An alloyed layer of alumina-zirconia may be produced by thermal spraying an alloyed powder made, for example, by bulk fusing and crushing the combined oxides. An advantageous production method for alloyed powder is to make an agglomerated composite powder as described below, feed such powder through a plasma or oxy-fuel gun to fuse the individual powder grains, and collect the solidified grains, which are spherodized into a free flowing powder. A method for producing such a powder is described in U.S. Pat. No. 3,974,245 (Cheney et al).

An alternative form of powder for the invention is a composite powder, such as an agglomerate of fine powders either sintered or bonded with a binder. When the composite form of powder is thermal sprayed there will be at least partial melting and diffusion of the alumina and zirconia, resulting in an alloy layer on the blade tip being coated. If the agglomerate contains medium size sub-powder, full solutioning may not occur and the alloy layer will contain separate phases also.

In the case of using a binder, the fine powders may be mixed in a vessel with a solvent and an organic binder (such as water and a water-soluble binder) and blended until dried and agglomerated into a composite. Another form of composite, where one constituent such as the alumina is present in a small proportion (e.g. 5%), is a clad powder. Such clad powder is made in a similar manner with a binder as described for metals in U.S. Pat. No. 3,436,248 (Dittrich et al), using large grains of the majority constituent and fine grains of the minority constituent.

Advantageously the composite powder is made by spray drying as disclosed in U.S. Pat. No. 3,617,358 (Dittrich). Very fine powders of both constituents, generally in the 2–10 micron range, are mixed into a slurry with water and a water-soluble organic binder. The slurry is spray dried into a powder which is classified into the selected size.

Bonding of the ceramic layer involves normal surface preparation techniques, generally at least by grit blasting of the blade tip such as with 210 micron alumina grit at 70 psi air pressure. An intermediate layer of a metal about 50 to 150 microns thick is advantageously applied by thermal spraying onto the prepared surface. This metal layer provides a rough surface especially suited for bonding the ceramic layer. The bonding layer preferably is an alloy of nickel-aluminum or cobalt-aluminum or nickel-cobalt aluminum, sprayed from either a composite or alloy powder. The alloy layer may be a simple alloy such as a nickel with 5% aluminum, or may additionally contain constituents such as chromium and yttrium oxide such as disclosed in the aforementioned U.S. Pat. No. 4,576,874. It may further be desirable to provide a second intermediate layer of porous ceramic as disclosed in this patent. Alternatively the intermediate bonding layer may be produced from a composite powder as taught in the aforementioned U.S. Pat. No. 3,436,248.

The intermediate layer is produced conventionally with any thermal spray gun deemed appropriate for the particular powder. For example one metal alloy powder has a composition of 6% aluminum, 17% chromium, 5% yttrium, balance nickel, and a size of 10 to 44 microns. This alloy is sprayed with a Metco Type 9MB plasma spray gun sold by The Perkin-Elmer Corporation, Norwalk, Conn., using a 732 nozzle, argon and hydrogen plasma-forming gas mixture at 80 scfh and 20 scfh respectively, 500 amperes, 75–80 volts, powder feed rate of 60 gm/min, spray distance 12–15 cm, and traverse rate 38 cm/sec.

By way of examples the ceramic powders in the following examples are sprayed onto rotor blade tips, generally to a thickness of about 0.1 to 0.2 mm. Bonding is effected either with grit blasting or with grit blasting followed by an intermediate metal alloy layer. In each case a hard, abrasive coating layer of ceramic is produced that is suitable for use with typical shroud materials such as a plasma sprayed coating of yttria stabilized zirconia or a smooth, dense metallic shroud. Bonding of the ceramic layer to the blade is very good, being best with an intermediate metal layer. Simulation tests of blade tip coatings of thermal sprayed blends of alumina and zirconia in a high temperature rubbing rig indicate performance at least as good as prior art layers of silicon carbide and boron nitride.

EXAMPLE 1

A simple blend of alumina (5–20 microns) and zirconia (10–90 microns, stabilized with 8% yttria) in equal weight proportions is sprayed with a HVOF gun of the type disclosed in the aforementioned U.S. Pat. No. 4,865,252 and sold as a Metco Type DJ gun by The Perkin-Elmer Corporation. Parameters are propylene gas at 7.0 kg/cm$^2$ and 79 l/min (standardized) oxygen at 0.5 kg/cm$^2$ and 327 l/min, air at 5.3 kg/cm$^2$ and 149 l/min, spray rate of 23 gm/min, spray distance of 10–13 cm, and traverse rate of 100 cm/sec. Volume composition of the coating is 45–60% alumina.

EXAMPLE 2

A simple blend of alumina and zirconia (stabilized with 8% yttria) having 75% by weight alumina, and a similar size to Example 1, is similarly sprayed. Volume composition of the coating is 50–80% alumina, the variation being attributed to fluctuations within the blend.

EXAMPLE 3

A simple blend of alumina and zirconia (stabilized with 8% yttria) having 25% by weight alumina, and a similar size to Example 1, is similarly sprayed. Volume composition of the coating is 17–40% alumina.

EXAMPLE 4

Three different blends are prepared, whereby an alumina powder having a size of 15 to 53 microns is blended with a yttria (8%) stabilized zirconia powder having a size of 10 to 106 microns in proportions of 5%, 15% and 25% by weight alumina respectively. These blends are plasma sprayed with a gun of the type described in U.S. Pat. No. 3,145,287 (Siebein) and sold as a Metco Type 9MB gun using a 730 nozzle, nitrogen and hydrogen plasma-forming gas mixture respectively at 75 scfh and about 10–15 scfh (as needed to maintain voltage), 600 amperes, 75 volts, 6.4 cm spray distance, and spray rate of 68 gm/min. All three coatings have increased resistance to erosion with increasing alumina content. The alumina is well dispersed and is laminar, and there is some microcracking which is desirable.

EXAMPLE 5

Several different blends of 10, 25, 50 and 75% alumina powder having a size of 15 to 53 microns and several different zirconia powders each are prepared. One zirconia is stabilized with 20% yttria and has a size of 10–90 microns. Another zirconia contains 24% magnesium oxide and has size of 10–53 microns; and another contains 5% calcium oxide and has size 30–75 microns. Yet another contains 2.5% yttrium oxide and 25% cerium oxide and has a size of −90+10 microns. Each blend is plasma sprayed as described for Example 4.

EXAMPLE 6

An alumina-zirconia composite powder is produced by the spray dry process. Constituent powders including unstabilized zirconia, each having a size of 2 to 5 microns, are mixed in equal weight proportions in a blender with a liquid vehicle, which may be alcohol or the like but preferably is water, and a binder. The binder is a spray dry type, namely a binder that may be subsequently decomposed and combusted or evaporated away or incorporated into the final product as required. Suitable binders and slip preparation are described in aforementioned U.S. Pat. No. 3,617,358. Some examples of binders are sodium carboxyl methyl cellulose (CMC) and polyvinyl pyrrolidone. Generally the amount of binder is in the range of 1% to 3% by weight of the precursor constituents, and preferably about 1.5% to 2.5%. The liquid vehicle should be between 0.15 cc and 0.2 cc for each gram of precursor. A wetting agent and/or other conventional minor additive may be added as needed.

The slip is then spray dried in the conventional manner, for example as described in the above-mentioned patent. The slip is thus atomized and dried into spray dried agglomerates with the water evaporated while the agglomerates pass through an oven temperature of 100° to 300° C. which also cures, dries or sets the binder. The agglomerates have a size broadly in the range of −100 mesh (−150 microns) +5 microns which may be separated conventionally into two size components, e.g. divided at about 44 microns, by a cyclone attachment to the spray dryer. The agglomerates are thus formed of the fine particles of the precursors.

Various size ranges similar to those of the previous examples are thermal sprayed with plasma and HVOF as described in the examples. In each case the zirconia and alumina are substantially fused in the heat of the process, effecting an alloyed ceramic layer.

EXAMPLE 7

Example 6 is repeated using constituent powders with a size of 10 to 20 microns. During thermal spraying of the composite powder with the HVOF process the constituents are too coarse to substantially alloy, resulting in a layer comprising the individual oxides.

While the invention has bee described above in detail with reference to specific embodiments, various changes and modifications which fall within the spirit of the invention and scope of the appended claims will become apparent to those skilled in this art. The invention is therefore only intended to be limited by the appended claims or their equivalents.

What is claimed is:

1. A rotor blade for a gas turbine engine having a plurality of rotor blades and a substantially coaxial shroud encompassing the tips of the blades, comprising a blade member with an inner end adapted for mounting on a rotation hub and with a blade tip located opposite the inner end, and a ceramic layer bonded to the blade tip, the ceramic layer consisting essentially of aluminum oxide and a zirconia-based oxide selected from the group consisting of zirconium oxide and at least partially stabilized zirconium oxide.

2. The rotor blade according to claim 1 wherein the ceramic layer is formed as a thermal sprayed coating.

3. The rotor blade according to claim 2 wherein the thermal sprayed coating is a plasma sprayed coating.

4. The rotor blade according to claim 2 wherein the thermal sprayed coating is a high velocity oxy-fuel sprayed coating.

5. The rotor blade according to claim 1 wherein the ceramic layer is bonded to the blade tip with a thermal sprayed intermediate layer of a metal.

6. The rotor blade according to claim 5 wherein the metal layer is selected from the group consisting of nickel-aluminum alloys, cobalt-aluminum alloys and nickel-cobalt-aluminum alloys.

7. The rotor blade according to claim 1 wherein the zirconia-based oxide is zirconium oxide at least partially stabilized with a further oxide selected from the group consisting of yttrium oxide, calcium oxide, cerium oxide, and magnesium oxide.

8. The rotor blade according to claim 7 wherein the further oxide is yttrium oxide.

9. The rotor blade according to claim 1 wherein the aluminum oxide is present in a proportion of about 2% to 85% by weight based on the total of the aluminum oxide and the zirconia-based oxide.

10. The rotor blade according to claim 9 wherein the proportion is about 40% to 60%.

11. The rotor blade according to claim 1 wherein the ceramic layer comprises substantially distinct phases of the aluminum oxide and the zirconia-based oxide.

12. The rotor blade according to claim 11 wherein the ceramic layer is formed by thermal spraying a blend of aluminum oxide and zirconia-based oxide powders.

13. The rotor blade according to claim 12 wherein the powders have a size substantially from 10 to 90 microns.

14. The rotor blade according to claim 1 wherein the ceramic layer comprises substantially alloyed aluminum oxide and zirconium oxide.

15. The rotor blade according to claim 14 wherein the ceramic layer is formed by thermal spraying a powder of aluminum oxide and zirconia-based oxide, the zirconia-based oxide being selected from the group consisting of zirconium oxide and at least partially stabilized zirconium oxide, and the powder being selected from the group consisting of composite powder and fused powder.

16. The rotor blade according to claim 15 wherein the powder has a size substantially from 10 to 90 microns.

17. A method of manufacturing a rotor blade for a gas turbine engine having a plurality of rotor blades and a substantially coaxial shroud encompassing the tips of the blades, the rotor blade having an inner end adapted for mounting on a rotation hub and a blade tip located opposite the inner end, the method comprising thermal spraying a ceramic layer consisting essentially of aluminum oxide and zirconia-based oxide onto the blade tip, the zirconia-based oxide being selected from the group consisting of zirconium oxide and at least partially stabilized zirconium oxide.

18. The method according to claim 17 wherein the thermal spraying is plasma spraying.

19. The method according to claim 17 wherein the thermal spraying is high velocity oxy-fuel spraying.

20. The method according to claim 17 further comprising thermal spraying an intermediate layer of a metal onto the blade tip prior to thermal spraying the ceramic layer.

21. The method according to claim 20 wherein the metal is selected from the group consisting of nickel-aluminum alloys, cobalt-aluminum alloys and nickel-cobalt-aluminum alloys.

22. The method according to claim 17 wherein the zirconia-based oxide is zirconium oxide at least partially stabilized with a further oxide selected from the group consisting of yttrium oxide, calcium oxide, cerium oxide and magnesium oxide.

23. The method according to claim 22 wherein the further oxide is yttrium oxide.

24. The method according to claim 17 wherein the aluminum oxide is present in a proportion of about 2% to 85% by weight based on the total of the aluminum oxide and the zirconia-based oxide.

25. The method according to claim 24 wherein the proportion is about 40% to 60%.

26. The method according to claim 17 wherein the thermal spraying comprises thermal spraying a blend of aluminum oxide and zirconia-based oxide powders.

27. The method according to claim 26 wherein the powders have a size substantially in the range of 10 to 90 microns.

28. The method according to claim 17 wherein the thermal spraying comprises thermal spraying a powder of aluminum oxide and zirconia-based oxide, the zirconia-based oxide being selected from the group consisting of zirconium oxide and at least partially stabilized zirconium oxide, and the powder being selected from the group consisting of composite powder and fused powder.

29. The method according to claim 28 wherein the powders has a size substantially from 10 to 90 microns.

* * * * *